US006325491B1

(12) United States Patent
Feinn

(10) Patent No.: US 6,325,491 B1
(45) Date of Patent: Dec. 4, 2001

(54) INKJET PRINTHEAD DESIGN TO REDUCE CORROSION OF SUBSTRATE BOND PADS

(75) Inventor: James A. Feinn, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/431,064

(22) Filed: Oct. 30, 1999

(51) Int. Cl.[7] ..... B41I 2/14
(52) U.S. Cl. ..... 347/50
(58) Field of Search ..... 347/65, 50, 58, 347/87, 62, 63, 85, 86

(56) References Cited

U.S. PATENT DOCUMENTS

| | | | |
|---|---|---|---|
| 4,313,684 | 2/1982 | Tazaki et al. . | |
| 4,490,728 | 12/1984 | Vaught et al. . | |
| 5,278,584 | 1/1994 | Keefe et al. . | |
| 5,291,226 | 3/1994 | Schantz et al. . | |
| 5,442,384 | 8/1995 | Schantz et al. . | |
| 5,638,101 | 6/1987 | Keef et al. | 347/65 |
| 5,648,805 | 7/1997 | Keefe et al. . | |
| 5,736,998 | 4/1998 | Caren et al. . | |
| 5,852,460 | 12/1998 | Schaeffer et al. . | |
| 5,953,032 | 9/1999 | Haarz et al. | 347/87 |

*Primary Examiner*—N. Le
*Assistant Examiner*—K. Feggins
(74) *Attorney, Agent, or Firm*—Dennis G. Stenstrom

(57) ABSTRACT

Disclosed is an inkjet printhead including a substrate having a plurality of individual ink ejection elements formed on a first surface of said substrate, said ink ejection elements electrically connected to bond pads on said substrate, a barrier layer formed on said first surface of said substrate, said barrier layer defining a plurality of individual ink ejection chambers, said barrier layer further providing isolation of the bond pads on the substrate and a flexible circuit having electrical traces formed thereon, said electrical traces having leads attached to said bond pads; said flexible circuit overlaying and affixed to said barrier layer such that a plurality of nozzles formed in a nozzle member portion of said flexible circuit, such that said nozzles align with said ink ejection chambers and said ink ejection elements.

24 Claims, 8 Drawing Sheets

INKJET PRINTHEAD DESIGN TO REDUCE CORROSION OF SUBSTRATE BOND PADS

CROSS-REFERENCE TO RELATED APPLICATIONS

This application relates to the subject matter disclosed in the following U.S. Patent Application and U.S. Patents:

U.S. patent application Ser. No. 09/302,837, filed Apr. 30, 1999, entitled "Inkjet Print Cartridge Design to Decrease Ink Shorts Due to Ink Penetration of the Printhead;"

U.S. patent application Ser. No. 09/303,246, filed Apr. 30, 1999, entitled "Inkjet Print Cartridge Design for Decreasing Ink Shorts By Using an Elevated Substrate Support Surface to Increase Adhesive Sealing of the Printhead from Ink Penetration;"

U.S. Pat. No. 5,442,384, entitled "Integrated Nozzle Member and TAB Circuit for Inkjet Printhead;"

U.S. Pat. No. 5,278,584 to Keefe, et al., entitled "Ink Delivery System for an Inkjet et Printhead;"

U.S. Pat. No. 5,291,226, entitled "Nozzle Member Including Ink Flow Channels."

The above patents are assigned to the present assignee and are incorporated herein by reference.

FIELD OF THE INVENTION

The present invention generally relates to inkjet printers and, more particularly, to the printhead portion of an inkjet print cartridge.

BACKGROUND OF THE INVENTION

Inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Inkjet printers print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of firing chambers which receive liquid ink from the ink reservoir. Each chamber has a thin-film resistor, known as a inkjet firing chamber resistor, located opposite the nozzle so ink can collect between it and the nozzle. The firing of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

In U.S. Pat. No. 5,442,384, entitled "Integrated Nozzle Member and TAB Circuit for Inkjet Printhead," a novel nozzle member for an inkjet print cartridge and method of forming the nozzle member are disclosed. A flexible circuit tape having conductive traces formed thereon has formed in it nozzles or orifices by Excimer laser ablation. The resulting flexible circuit having orifices and conductive traces may then have mounted on it a substrate containing heating elements associated with each of the orifices. The conductive traces formed on the back surface of the flexible circuit are then connected to the electrodes on the substrate and provide energization signals for the heating elements. A barrier layer, which may be a separate layer or formed in the nozzle member itself, includes vaporization chambers, surrounding each orifice, and ink flow channels which provide fluid communication between a ink reservoir and the vaporization chambers.

In U.S. Pat. No. 5,648,805, entitled "Adhesive Seal for an Inkjet Printhead," a procedure for sealing an integrated nozzle and flexible or tape circuit to a print cartridge is disclosed, A nozzle member containing an array of orifices has a substrate, having heater elements formed thereon, affixed to a back surface of the flexible circuit. Each orifice in the flexible circuit is associated with a single heating element formed on the substrate. The back surface of the flexible circuit extends beyond the outer edges of the substrate. Ink is supplied from an ink reservoir to the orifices by a fluid channel within a barrier layer between the flexible circuit and the substrate. In either embodiment, the flexible circuit is adhesively sealed with respect to the print cartridge body by forming an ink seal, circumscribing the substrate, between the back surface of the flexible circuit and the body. This method and structure of providing a seal directly between a flexible circuit and an ink reservoir body has many advantages. Also, in U.S. Pat. No. 5,736,998, entitled "Inkjet Cartridge Design for Facilitating the Adhesive Sealing of a Printhead to an Ink Reservoir," and U.S. Pat. No. 5,852,460, entitled "Inkjet Print Cartridge Design to Decrease Deformation of the Printhead When Adhesively Sealing The Printhead to the Print Cartridge;" improved headland designs are disclosed which alleviate some of the above-mentioned problems.

Flexible circuit leads are bonded to pads or electrodes on the outer edges of the substrate. To enable this bonding, a window is created in the flexible circuit to allow a bonder thermode to apply force and temperature to the flexible circuit leads that are resting on the bond pads. After the leads have been bonded, an encapsulant is dispensed across the window to protect the exposed bond pad region from intrusion of ink or contamination.

On most flexible circuits these leads are also protected on the back side by a laminated cover layer. In addition, the leads are further protected by the structural adhesive that is used to adhere the flexible circuit to the print cartridge body. However, there is a region at both ends of the substrate where the flexible circuit traces cannot be protected by the cover layer. In this region, the traces are only protected by the structural adhesive, and are therefore susceptible to corrosion and electrical shorting if ink penetrates the structural adhesive to flexible tape interface. This penetration of ink is increased due to the fact that the flexible tape to structural interface provides a wicking surface for the ink. This can lead to corrosion and electrical shorting behind the substrate. In addition, the encapsulant and the structural adhesive are cured at different stages in the manufacturing process and this creates a weak "cold joint" between the adhesive and encapsulant that can fail and permit ink intrusion. Finally, air pockets may be created on the underside of the flexible tape near the ends of the substrate when the structural adhesive does not squish uniformly against the flexible circuit during attachment of the flexible circuit to the print cartridge body. These air pockets can provide a path for ink to the flexible circuit traces or the bond pad region and thus lead to corrosion and electrical shorting of the leads or traces.

In inkjet printheads, adjacent electrodes or bond pads located on the printhead substrate can act as an anode and cathode and with ink serving as an electrolytic fluid. In this situation, bond pad electrochemical corrosion will occur due to the migration of metal ions under the driving force of the electric field established by a voltage bias.

In prior printheads this problem was minimal because they employed center-feed/side-connect designs. The older center-feed/side-connect designs were more robust because the bond pad regions were further away from the ink channel. Newer designs employ edge-feed/end connect designs to enable space on the die for active logic and an increased number of nozzles. This means the bond pads are closer to the ink channel.

Accordingly, there is a need for an improved method of isolating adjacent bond pads on the substrate to reduce ink corrosion due to ink penetration into the bond pad region of the substrate.

SUMMARY OF THE INVENTION

The present invention provides for the isolation of adjacent bond pads on the substrate to reduce ink corrosion due to ink penetration into the bond pad region of the substrate. The inkjet printhead includes a substrate having a plurality of individual ink ejection elements formed on a first surface of said substrate, said ink ejection elements electrically connected to bond pads on said substrate, a barrier layer formed on said first surface of said substrate, said barrier layer defining a plurality of individual ink ejection chambers, said barrier layer further providing isolation of the bond pads on the substrate and a flexible circuit having electrical traces formed thereon, said electrical traces having leads attached to said bond pads; said flexible circuit overlaying and affixed to said barrier layer such that a plurality of nozzles formed in a nozzle member portion of said flexible circuit, such that said nozzles align with said ink ejection chambers and said ink ejection elements.

DETAILED DESCRIPTION OF THE PREFERRED EMBODIMENTS

Figure 1:
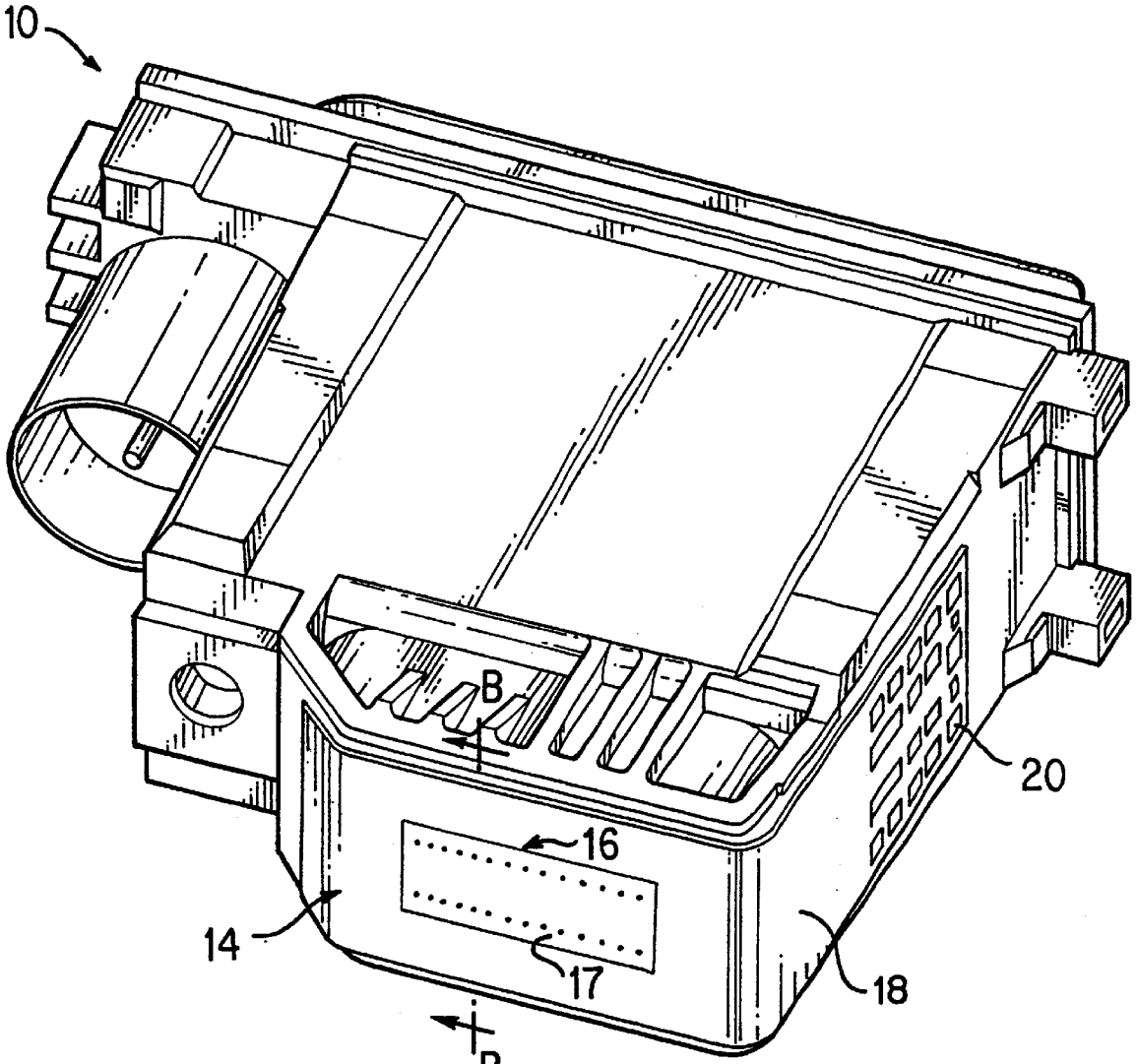
FIG. 1 is a perspective view of an inkjet print cartridge.

Referring to FIG. 1, reference numeral 10 generally indicates an inkjet print cartridge incorporating a printhead according to one embodiment of the present invention. The inkjet print cartridge 10 includes an internal ink reservoir (not shown) and a printhead formed using Tape Automated Bonding (TAB). The printhead or TAB head assembly 14 includes a nozzle member 16 comprising two parallel columns of offset holes or orifices 17 formed in a flexible polymer flexible circuit 18 by, for example, laser ablation. The flexible circuit 18 provides for the routing of conductive traces 36 which are connected at one end to electrodes on a substrate and on the other end to contact pads 20. The print cartridge 10 is designed to be installed in a printer so that the contact pads 20 on the front surface of the flexible circuit 18, contact printer electrodes providing externally generated energization signals to the printhead.

Figures 2A, 2B:
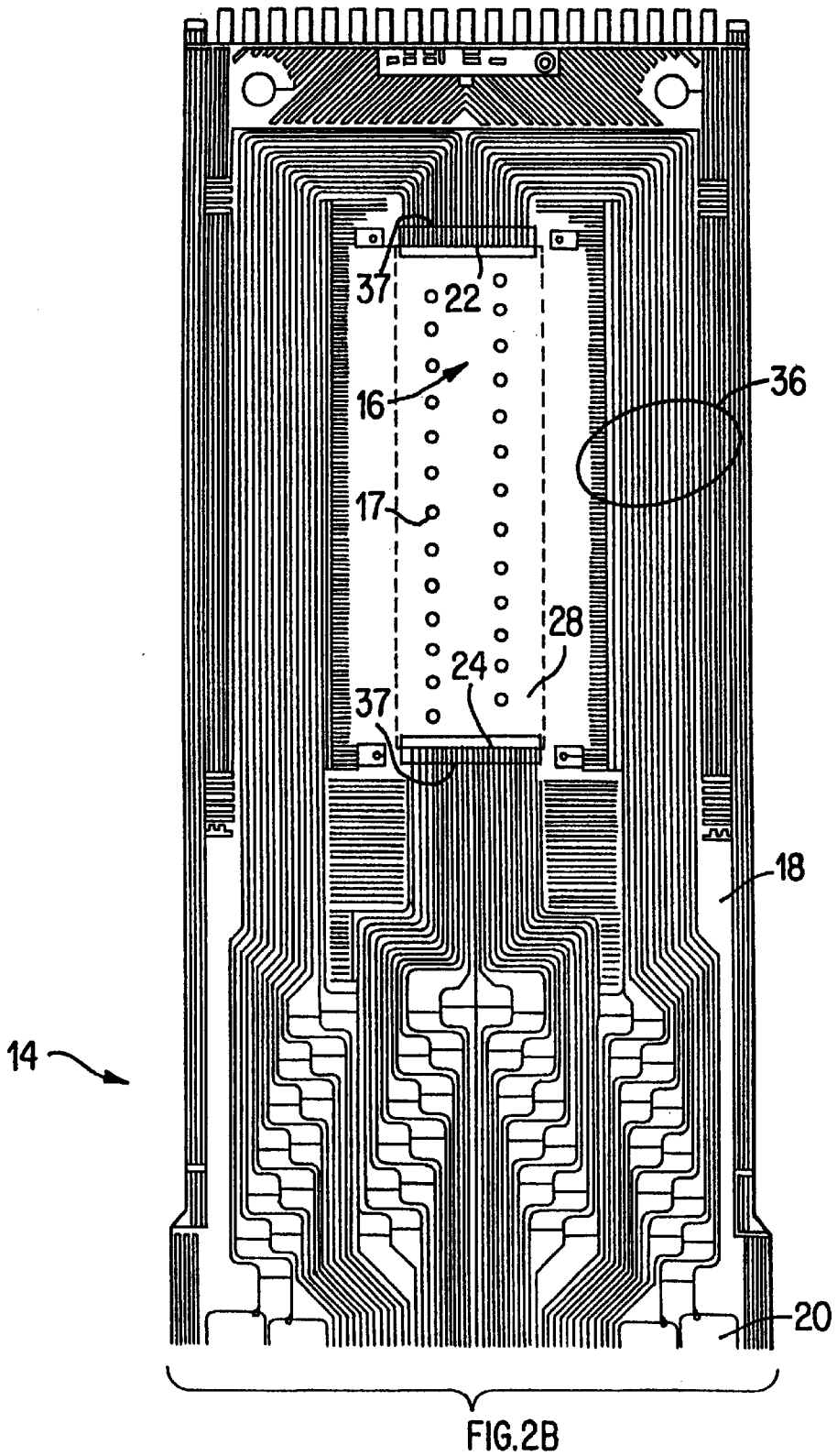
FIG. 2 is a plan view of the front surface of a printhead assembly removed from a print cartridge.
Figures 2A, 2B:
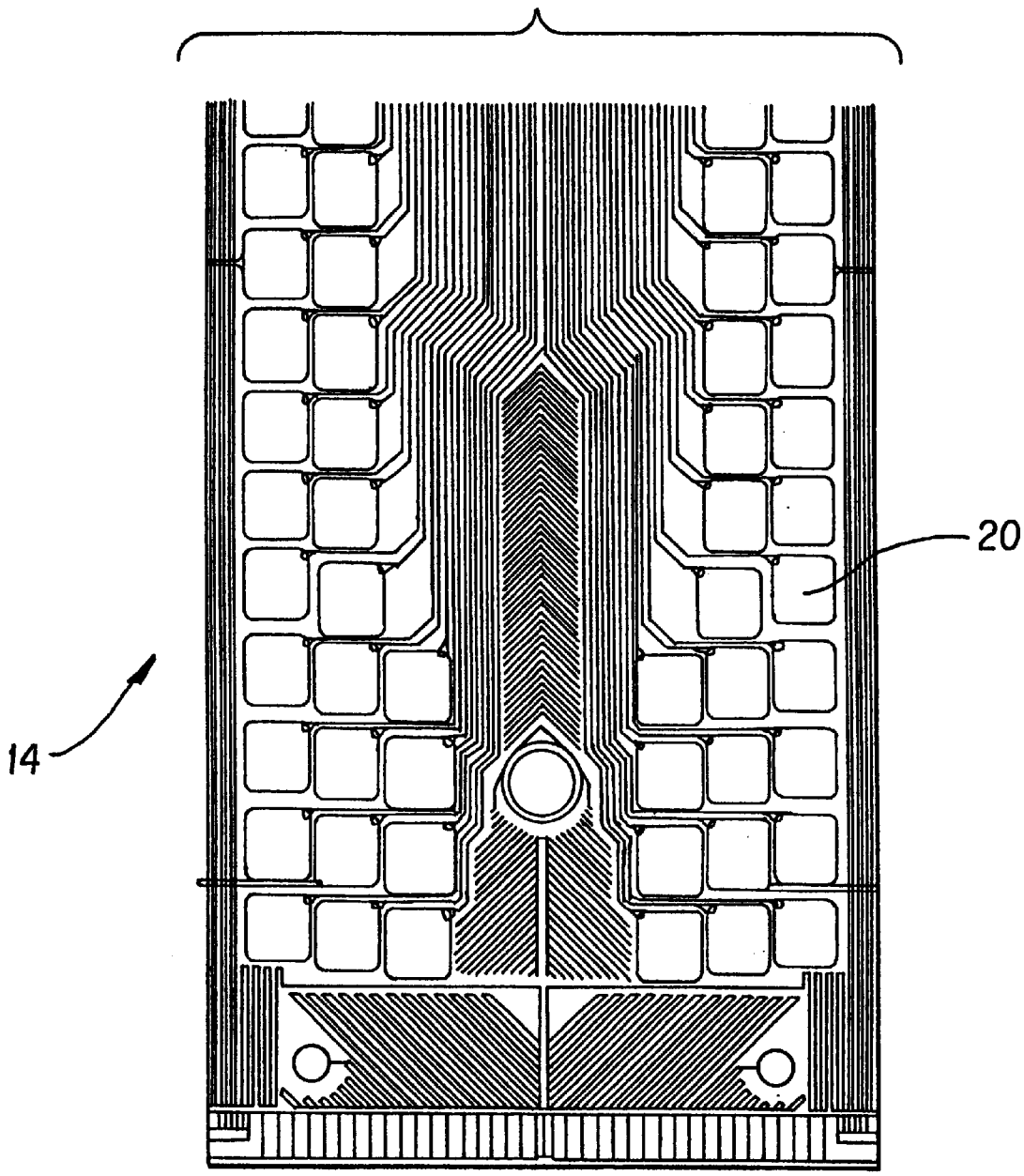

FIG. 2 shows a front view of a TAB head assembly 14 removed from a print cartridge 10. TAB head assembly 14 has affixed to the back of the flexible circuit 18 a silicon substrate 28 containing a plurality of individually energizable thin film resistors. Each resistor is located generally behind a single orifice 17 and acts as an ohmic heater when selectively energized by one or more pulses applied sequentially or simultaneously to one or more of the contact pads 20.

Flexible circuit leads are bonded to pads or electrodes 40 on the outer edges of the substrate 28. To enable this bonding, a windows 22, 24 which extend through the flexible circuit 18 are created in the flexible circuit 18 to allow a bonder thermode to apply force and temperature to the flexible circuit leads 37 that are resting on the bond pads 40. The windows 22, 24 in the TAB head assembly 14 are chemically milled in the flexible tape 18. Earlier during intermediate assembly of the TAB head assembly 14 after the leads 37 have been bonded to the bond pads 40, an encapsulant 34 is dispensed across the windows 22, 24 from the top to protect the exposed bond pad region from intrusion of ink or contamination.

The portion of the windows 22, 24 which are off the substrate extend back approximately to the location on the flexible circuit 18 where the laminated cover layer 38 of the flex circuit 18 terminates. Thus, the openings in windows 22, 24 must be large enough to be open near the end of the cover layer 38 so that the leads 37 without any cover layer 38 are fully encapsulated by adhesive 90 and encapsulant 34. For additional details on intermediate assembly, see U.S. Pat. No. 5,442,384, entitled "Integrated Nozzle Member and TAB Circuit for Inkjet Printhead;" and U.S. Pat. No. 5,278, 584 to Keefe, et al., entitled "Ink Delivery System for an Inkjet Printhead;" which are herein incorporated by reference.

The orifices 17 and conductive traces 36 may be of any size, number, and pattern, and the various figures are designed to simply and clearly show the features of the invention. The relative dimensions of the various features have been greatly adjusted for the sake of clarity.

Figure 3:
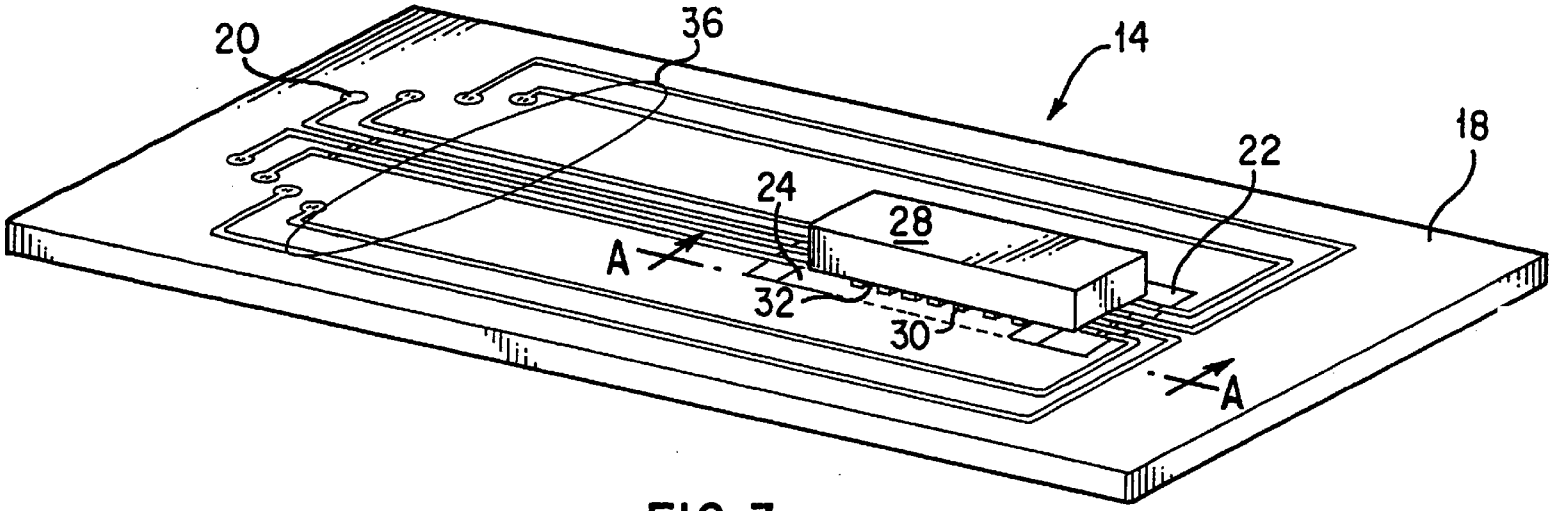
FIG. 3 is a highly simplified perspective view of the back surface of the printhead assembly of FIG. 2 with a silicon substrate mounted thereon and the conductive leads attached to the substrate.

FIG. 3 shows a highly simplified view of the back surface of a TAB head assembly 14. The back surface of the flexible circuit 18 includes conductive traces 36 formed thereon using a conventional photolithographic etching and/or plating process. The silicon die or substrate 28 is mounted to the back of the flexible circuit 18 with the ink vaporization chambers 32 aligned with the nozzles or orifices 17. The conductive traces 36 are terminated by leads 37 that are bonded to bond pads or electrodes 40 on the substrate 28 and on the other end by contact pads 20 as discussed above. Also shown is one edge of the barrier layer 30 containing vaporization chambers 32 formed on the substrate 28. Shown along the edge of the barrier layer 30 are the entrances to the vaporization chambers 32 which receive ink from an internal ink reservoir within the print cartridge 10.

Figure 4:
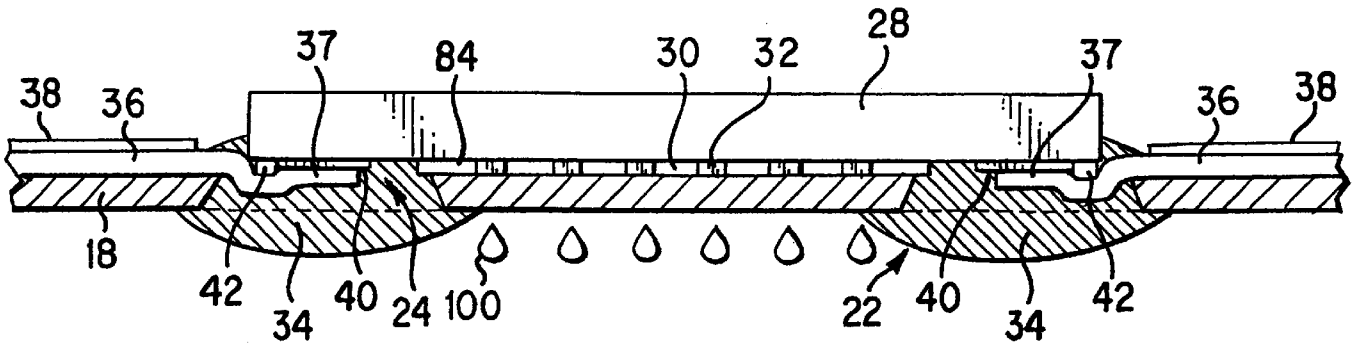
FIG. 4 is a side elevational view in cross-section taken along line A—A in FIG. 3 illustrating the attachment of conductive leads to electrodes on the silicon substrate.

FIG. 4 shows a side view cross-section taken along line A—A in FIG. 3 illustrating the connection of the leads 37 of the conductive traces 36 to the electrodes 40 formed on the substrate 28. A portion 42 of the barrier layer 30 is used to insulate the conductive traces 36 from the substrate 28. Also shown is the flexible circuit 18, the barrier layer 30, the windows 22 and 24 and the entrances to the ink vaporization chambers 32. Also shown is the encapsulant 34 that is dispensed into the windows 22, 24 after bonding of the leads 37 to the bond pads 40 to insulate the leads 37 and conductive traces 36. Droplets of ink 100 are shown being ejected from orifices 17 associated with each of the ink vaporization chambers 32.

Figure 5:
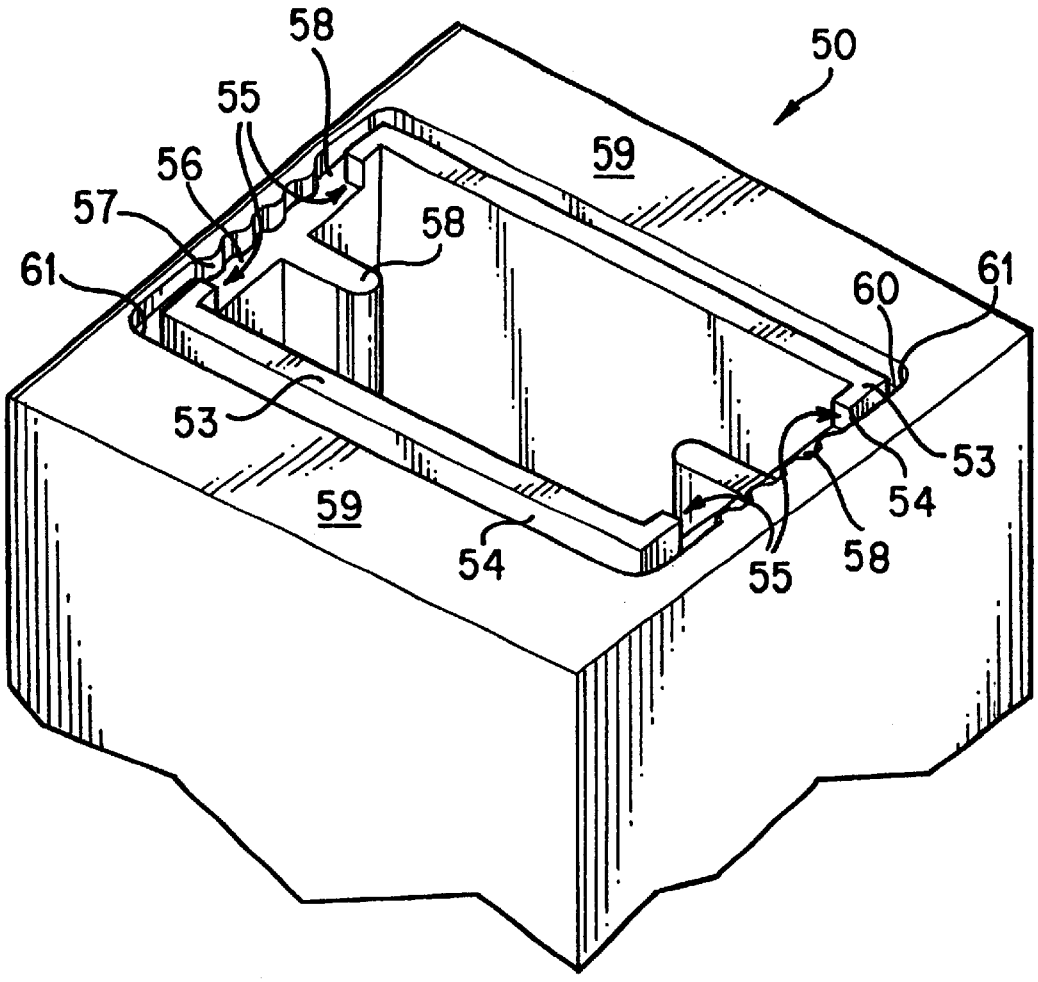
FIG. 5 is a perspective view of the headland area of the inkjet print cartridge of FIG. 1 with the printhead assembly removed.

FIG. 5 shows the headland area 50 of print cartridge 10 of FIG. 1 in a perspective view and with the TAB head assembly 14 removed to reveal the headland design used in providing a seal between the TAB head assembly 14 and the body of the print cartridge 10. Shown are an inner raised wall 54, an adhesive support surface 53 on the inner raised wall, openings 55 in the inner raised wall 54, a substrate support surface 58, a flat top surface 59 and a gutter 61. Also shown are adhesive ridges 57 and the area 56 on the substrate support surface 58 between the adhesive ridges 57. Adhesive 90 is dispensed along the adhesive support surface 53 of inner raised wall 54 and across substrate support surface 58 in the wall openings 55 of the inner raised wall 54 and adjacent to and suspended off adhesive ridges 57.

As the TAB head assembly 14 is pressed down onto the headland 50, the adhesive 90 is squished down. The adhesive squishes through the wall openings 55 in the inner raised wall to encapsulate the traces leading to electrodes on the substrate. The adhesive 90 also squishes both inwardly and upwardly through the windows 22, 24 and flush with the bottom surface of the encapsulant and partially encapsulates the exposed leads 37.

This seal formed by the adhesive 90 circumscribing the substrate 28 allows ink to flow around the sides of the substrate 28 to the vaporization chambers 32 formed in the barrier layer 30, but prevents ink from seeping out from under the TAB head assembly 14. Thus, this adhesive seal 90 provides a strong mechanical coupling of the TAB head assembly 14 to the print cartridge 10, a fluidic seal and flexible circuit lead encapsulation.

Figure 6:
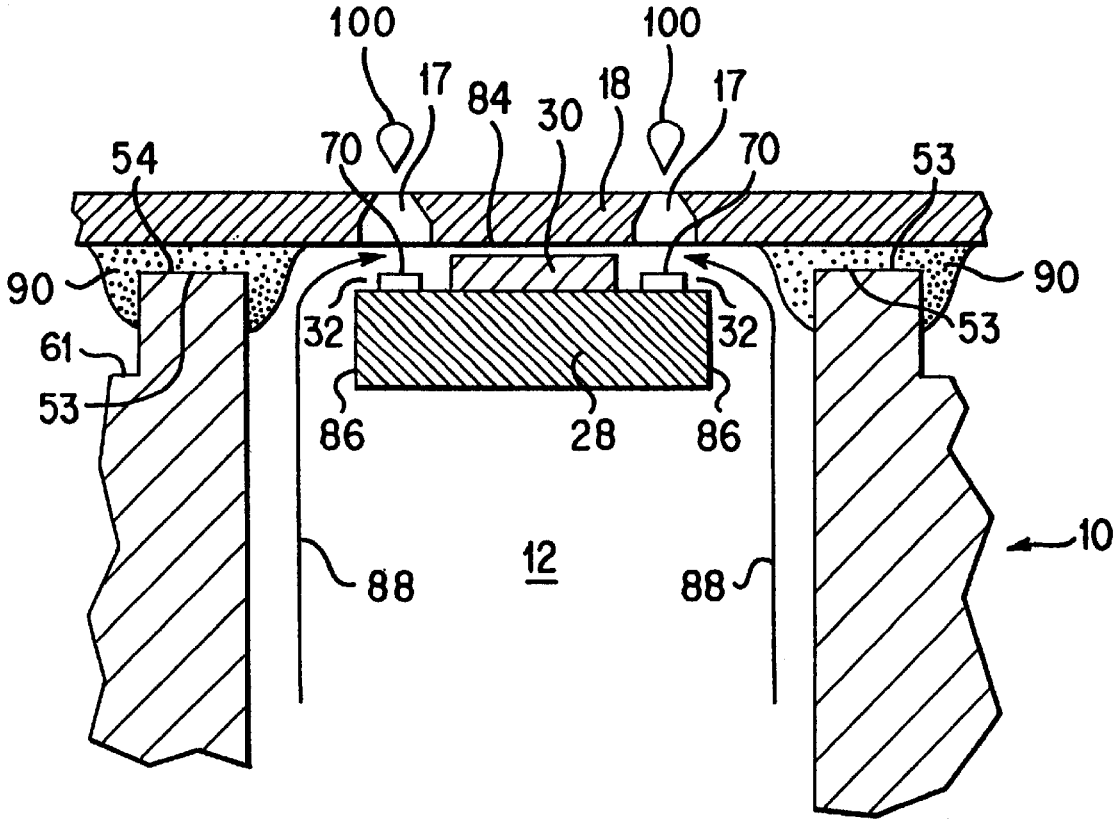
FIG. 6 is a schematic cross-sectional view taken along line B—B of FIG. 1 showing the adhesive seal between the printhead assembly and the print cartridge.

FIG. 6 is a cross-sectional view taken along line B—B of FIG. 1 showing vaporization chambers 32, thin film resistors 70, and orifices 17 after the barrier layer 30 and substrate 28 are secured to the back of the flexible circuit 18 at location 84 and the flexible circuit is secured to the body of the print cartridge 10 by adhesive 90. A side edge of the substrate 28 is shown as 86. In operation, ink flows from reservoir 12 around the side edge 86 of the substrate 28, and into vaporization chamber 32, as shown by the arrow 88. Upon energization of the thin film resistor 70, a thin layer of the adjacent ink is superheated, causing a droplet of ink 100 to be ejected through the orifice 17. The vaporization chamber 32 is then refilled with ink by capillary action. Also shown is a portion of the adhesive seal 90, applied to the inner raised wall 54 surrounding the substrate 28.

The adhesive 90 and the encapsulant 34 are effective at preventing shorting between the leads, but are not effective at isolating the gold/tantalum bond pads because the adhesive 90 and encapsulant 34 do not adhere well to gold. The situation is worsened by the close proximity of adjacent bond pads on the substrate 28. A typical separation distance between bond pads on a printhead is 20–40 $\mu$m. Ink shorts and bond pad corrosion cause malfunctioning of the printhead and premature failure of the print cartridge.

Prior printhead designs have not adequately addressed the problem of corrosion occurring near the bond pads 40 on the substrate and leads 37 of the flexible circuit 18 of TAB head assembly 14 due to ink penetration. The adjacent electrodes or bond pads 40 located on the printhead substrate 28 act as an anode and cathode with the ink serving as an electrolytic fluid. In this situation, bond pad electrochemical corrosion will occur due to the migration of metal ions under the driving force of the electric field established by a voltage bias. This causes the formation of dendrites between adjacent bond pads and malfunctioning and failure of the printhead.

Figure 7:
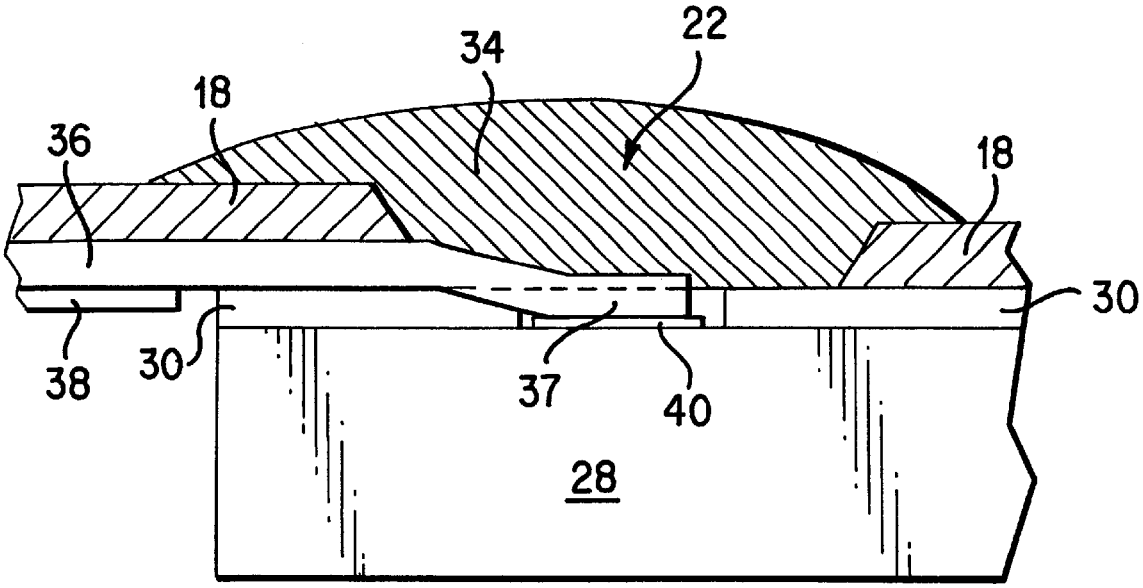
FIG. 7 is an elevational cross-sectional view of the bond pad region of the present invention.

FIG. 7 is a cross-sectional view of the bond pad 40 region of the present invention. Referring to FIG. 7, the present invention solves the bond pad electrochemical corrosion problem by isolating the individual bond pads 40 with barrier 30 material. Barrier 30 material is placed between adjacent bond pads 40 (shown in FIG. 8). The barrier 30 material also extends along the length of the substrate 28 up to bond pads 40 from the center of the substrate 28 and also extends from the bond pads 40 to the end of the substrate 28. Accordingly, the bond pads 40 are completely circumscribed by barrier 30 material. This barrier 30 material also lies under the under the traces 36 to the end of the substrate 28. The barrier material 30 isolates the bond pads 40 and the leads 37 and prevents corrosion and electrical shorting by eliminating the electrolytic path between adjacent leads 37 and bond pads 40. Also shown is the encapsulant 34 placed in the windows 22, 24 after bonding of the leads 37 to the bond pads 40. The adhesive 90 discussed above will help insulate the conductive traces 36 between the end of the substrate and the end of the cover layer 38 when the printhead is mounted to the headland 50 of the print cartridge body 12. The encapsulant 34 and the adhesive 90 may be the same or different materials.

Figure 8:
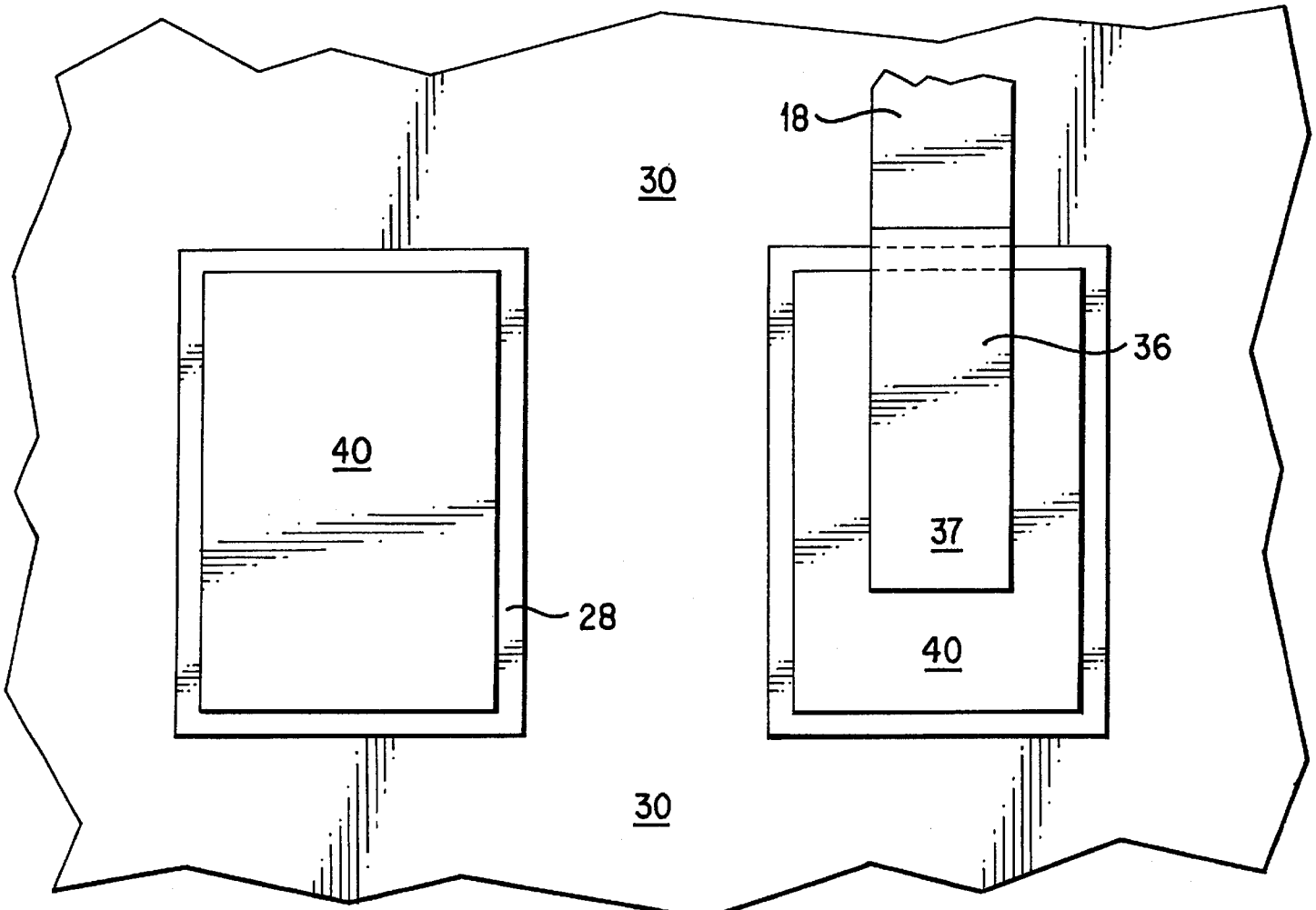
FIG. 8 is a top plan view of the bond pad region showing the interlocking barrier pattern of the present invention.

FIG. 8 is a top plan view of the bond pad region showing the interlocking barrier pattern of the present invention. Barrier 30 material is placed between adjacent bond pads 40. The barrier 30 material also extends along the length of the substrate 28 up to bond pads 40 from the center of the substrate 28 and also extends from the bond pads 40 to the end of the substrate 28. The is a narrow gap between the barrier material 30 and the bond pads 40 due to manufacturing tolerances. Accordingly, the bond pads 40 are completely circumscribed by barrier 30 material. Also shown are conductive traces 36 of the flexible circuit 18 and leads 37 bonded to the bond pads 40. While the bond pads are shown in FIG. 8 as being the same size, the bond pads can be of different size depending on the current load to the bond pad 40. As shown in FIG. 8, one of the bond pads 40 is shown with a lead 37 attached and the other with no lead attached.

In a typical inkjet printhead assembly 14, during the process of bonding the leads 37 to the bond pads 40, the thermode applies a force sufficient to compress typical leads 37 approximately 10 to 50 percent. If the nominal barrier thickness is such that the barrier height is the same as the height of the compressed leads 37 during bonding, it is evident that the bonder thermode would come in contact with barrier layer 30 placed between the pads 40. If this occurs the thermode would melt the barrier 30 material and become contaminated with the barrier material. Therefore, if barrier material is placed between the bond pads 40 either the traces 36 and leads 37 need to be thick enough so that compression of the leads 37 does not cause contact with the barrier material. Making the copper traces 36 and leads 37 thicker prevents the bonder thermode from contacting the barrier layer 30 between the bond pads 40 during intermediate assembly of the TAB head assembly 14. Moreover, making the traces 36 thicker enables a reduction in the width of traces 36 and leads 37 and this allows the traces to be moved closer together and thus farther away from the ink channels 32 without increasing the overall width of the printhead assembly 14. Alternatively, the thermode bonder needs to be redesigned, for example, in a notched like manner so that the thermode only contacts the leads 37 and not the barrier material 30. Redesigning the thermode bonder like this would require better alignment between the thermode and the leads 37.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An inkjet printhead comprising:

a substrate having a plurality of individual ink ejection elements formed on a first surface of said substrate, said ink ejection elements electrically connected to bond pads on said substrate;

a barrier layer formed on said first surface of said substrate, said barrier layer defining a plurality of individual ink ejection chambers, said barrier layer patterned to provide isolation of the bond pads on the substrate while allowing access to the bond pads through a barrier opening pattern; and a flexible circuit having electrical traces formed thereon, said electrical traces having leads attached to said bonds pads; said flexible circuit overlaying and affixed to said barrier layer such that a plurality of nozzles formed in a nozzle member portion of said flexible circuit, such that said nozzles align with said ink ejection chambers and said ink ejection elements.

2. The printhead of claim 1 wherein the barrier material further isolates the electrical traces and leads.

3. The printhead of claim 1 wherein the barrier material extends from the bond pads on the substrate to the edge of the substrate.

4. The printhead of claim 1 wherein the barrier material extends from the bond pads on the substrate to the end of the cover layer on the flexible circuit.

5. The printhead of claim 1 wherein the barrier material extends continuously from the bond pads on the substrate to the ink ejection chambers defined by the barrier layer.

6. The printhead of claim 1 wherein the barrier layer extends from the substrate bond pads to the cover layer of the electrical leads.

7. The printhead of claim 1 wherein the electrical traces and leads are sufficiently thicker than the barrier layer such that a thermode bonding the leads to the bond pads does not contact the barrier layer.

8. The printhead of claim 1 wherein the electrical traces and leads are approximately 10 to 50 percent thicker than the barrier layer such that a thermode bonding the leads to the bond pads does not contact the barrier layer.

9. The printhead of claim 1 wherein said back surface of said nozzle member extends over two or more outer edges of said substrate.

10. The printhead of claim 1 wherein the flexible circuit is formed of a flexible polymer material.

11. The printhead of claim 1 wherein the flexible circuit further includes window openings therein, the window openings exposing electrical traces on the flexible circuit in the region of the bond pads.

12. The printhead of claim 11 further including an encapsulant in the window openings for protecting said electrical traces and bond pads.

13. An inkjet print cartridge comprising:

a printhead including, a substrate having a plurality of individual ink ejection elements formed on a first surface of said substrate, said ink ejection elements electrically connected to bond pads on said substrate;

a barrier layer formed on said first surface of said substrate, said barrier layer defining a plurality of individual ink ejection chambers, said barrier layer further patterned to provide isolation of the bond pads on the substrate while allowing access to the bond pads through a barrier opening pattern; and a flexible circuit having electrical traces formed thereon, said electrical traces having leads attached to said bond pads; said flexible circuit overlaying and affixed to said barrier layer such that a plurality of nozzles formed in a nozzle member portion of said flexible circuit, such that said nozzles align with said ink ejection chambers and said ink ejection elements;

a print cartridge body having a headland portion located proximate to the back surface of said nozzle member and including an inner raised wall circumscribing the substrate, the inner raised wall having an adhesive support surface formed thereon and having wall openings therein, said wall openings having an adhesive support surface; and an adhesive layer located between the back surface of said nozzle member and the headland to affix said nozzle member to said headland and form an adhesive ink seal, said adhesive layer located on the adhesive support surface of the inner raised wall and along the adhesive support surface within the wall openings therein and within the window openings so as to encapsulate the electrical leads bonded to the substrate bond pads.

14. The printhead of claim 13 wherein the barrier material further isolates the electrical traces and leads.

15. The printhead of claim 13 wherein the barrier material extends from the bond pads on the substrate to the edge of the substrate.

16. The printhead of claim 13 wherein the barrier material extends from the bond pads on the substrate to the end of the cover layer on the flexible circuit.

17. The printhead of claim 13 wherein the barrier material extends continuously from the bond pads on the substrate to the ink ejection chambers defined by the barrier layer.

18. The printhead of claim 13 wherein the barrier layer extends from the substrate bond pads to the cover layer of the electrical leads.

19. The printhead of claim 13 wherein the electrical traces and leads are sufficiently thicker than the barrier layer such that a thermode bonding the leads to the bond pads does not contact the barrier layer.

20. The printhead of claim 13 wherein the electrical traces and leads are approximately 10 to 50 percent thicker than the barrier layer such that a thermode bonding the leads to the bond pads does not contact the barrier layer.

21. An inkjet printhead comprising:

a substrate having a plurality of individual ink ejection elements formed on a first surface of said substrate, said ink ejection elements electrically connected to a bond pads on said substrate;

a barrier layer formed on said first surface of said substrate, said barrier layer defining a plurality of individual ink ejection chambers, said barrier layer further providing isolation of the bond pads on the substrate; and a flexible circuit having electrical traces formed thereon and a cover layer formed over the electrical traces and having a substrate opening formed in the cover layer, with a plurality of nozzles formed in a nozzle member portion of said flexible circuit, said electrical traces having leads attached to said bonds pads; said flexible circuit overlaying and affixed to said barrier layer such that said nozzles align with said ink ejection chambers and said ink ejection elements, and wherein the barrier layer extends from the substrate bond pads to the cover layer of the electrical leads.

22. An inkjet print cartridge comprising:

a printhead including, a substrate having a plurality of individual ink ejection elements formed on a first surface of said substrate, said ink ejection elements electrically connected to bond pads on said substrate;

a barrier layer formed on said first surface of said substrate, said barrier layer defining a plurality of individual ink ejection chambers, said barrier layer further providing isolation of the bond pads on the substrate; and a flexible circuit having electrical traces formed thereon and a cover layer formed over the electrical traces and having a substrate opening formed in the cover layer, with a plurality of nozzles formed in a nozzle member portion of said flexible circuit, said electrical traces having leads attached to said bonds pads; said flexible circuit overlaying and affixed to said barrier layer such that said nozzles align with said ink ejection chambers and said ink ejection elements, and wherein the barrier layer extends from the substrate bond pads to the cover layer of the electrical leads;

a print cartridge body having a headland portion located proximate to the back surface of said nozzle member and including an inner raised wall circumscribing the substrate, the inner raised wall having an adhesive support surface formed thereon and having wall openings therein, said wall openings having an adhesive support surface; and an adhesive layer located between the back surface of said nozzle member and the headland to affix said nozzle member to said headland and form an adhesive ink seal, said adhesive layer located on the adhesive support surface of the inner raised wall and along the adhesive support surface within the wall openings therein and within the window openings so as to encapsulate the electrical leads bonded to the substrate bond pads.

23. The printhead of claim 1, wherein said barrier layer circumscribes each of said bond pads.

24. The printhead of claim 13, wherein said barrier layer circumscribes each of said bond pads.

* * * * *